US005662416A

United States Patent [19]

Dwigans, II

[11] Patent Number: 5,662,416

[45] Date of Patent: Sep. 2, 1997

[54] AUTOMATIC CLAMPING APPARATUS FOR PAINT MIXERS

[76] Inventor: Edward Jefferson Dwigans, II, 2985 Little Hurricane Rd., Martinsville, Ind. 46151

[21] Appl. No.: 640,142

[22] Filed: Apr. 30, 1996

[51] Int. Cl.[6] ..... B01F 3/00

[52] U.S. Cl. ..... 366/209; 366/605

[58] Field of Search ..... 366/605, 110, 366/114, 209, 219, 214, 111

[56] References Cited

U.S. PATENT DOCUMENTS

| | | | |
|---|---|---|---|
| 3,328,004 | 6/1967 | Beichle | 259/81 |
| 4,134,689 | 1/1979 | Ahrenskou-Sorensen | 366/110 |
| 4,588,302 | 5/1986 | Pizzi et al. | 366/349 |
| 4,842,415 | 6/1989 | Cane et al. | 366/110 |
| 5,066,136 | 11/1991 | Johnson | 366/209 |
| 5,261,744 | 11/1993 | Brown | 366/605 |
| 5,268,620 | 12/1993 | Hellenberg | 318/114 |
| 5,443,314 | 8/1995 | Gatlin | 366/215 |
| 5,462,353 | 10/1995 | Gatlin | 366/209 |

*Primary Examiner*—Tony G. Soohoo

*Attorney, Agent, or Firm*—Heidi A. Boehlefeld; Robert E. McDonald; John L. Ambrogi

[57] ABSTRACT

An automatic clamping apparatus for paint mixers which applies a direct downward force on a paint container to prevent movement during the mixing operation, includes a clamping plate, a linear actuator, and a current sensor. The clamping plate is secured to the moving end of a vertically aligned linear actuator which moves the clamping plate up and down onto a paint container. The current sensor detects when the clamping plate is pushing against the top of the paint container and the power to the actuator is adjusted accordingly to maintain securing force on the paint container.

11 Claims, 3 Drawing Sheets

AUTOMATIC CLAMPING APPARATUS FOR PAINT MIXERS

This invention relates to paint mixing machines which operate on paint containers. More specifically, the invention relates to an automatic clamping apparatus for securing a paint container during mixing operations by exerting securing force on the container.

BACKGROUND OF THE INVENTION

Paint mixing machines have improved the ease of preparing paints, particularly when custom matching colors for individual paint orders. By using such paint mixers, a desired color or texture can be quickly and economically produced by store clerks or even the consumer by simply adding the predetermined quantity of the various colors to the base paint, and placing the paint container into the mixer. This procedure obviates the expense of mixing paint in large quantities using industrial type mixing machines, which require a significant amount of labor, time and skill. The new generation of paint mixers can be kept conveniently at the business of paint retailers who can immediately fill custom orders. The development of more automated mixing devices has resulted in a savings of time and reduced costs in producing paint, as well as convenience to consumers.

A common type of available paint mixers is the paint shaker, in which the paint container is placed within a shaking compartment and shaken until the contents have been sufficiently mixed. The paint container must be tightly secured into place before the shaking operation commences so that the shaking motion is transferred to the paint container and also to prevent spillage and potential damage to the paint container and mixing apparatus. Therefore, the proper and adequate securing of the paint container within a paint shaker is of great importance.

In the past, paint containers were manually secured and sealed through various mechanical locking devices, such as a clamping plate which is latched down onto the top of the container by the operator. Additionally, the operator could manually lower the electrically or pneumatically driven clamping plates by operating a switch until the clamping plate pressed down on the top of the paint container. These types of clamping devices required manual operation of the clamping device, requiring more time to operate the machine and more skill of the operator who had to judge at what point the paint container was sufficiently secured without possibly crushing the container and damaging the seal.

Automatic clamping devices were developed to make securing the paint container easier, but suffer from certain disadvantages which render them less efficient. One such automatic clamping device is shown in U.S. Pat. No. 4,134,689 which includes two vertically aligned and parallel threaded rods, a clamping plate with two threaded openings to receive the rods, a drive-belt, and an electric motor. The two rods are linked axially by a drive-belt at the top end, allowing the two rods to rotate in unison when either rod is driven by an electric motor. The rotation of the two rods screws and unscrews the clamping plate up or down to secure the paint container. Additionally, a voltage sensor detects when the clamping plate is pushed against the container top to shut off the electric motor.

One drawback in this design is the time required to raise and lower the clamping plate because the vertical movement of the clamping plate is effected by screwing motions. The additional time becomes most apparent when dealing with containers of varying sizes and when many paint containers require mixing. Because the clamping plate is indirectly moved through a screwing motion, as opposed to a direct vertical force onto the clamping plate, more energy is expended to create the vertical movement of the clamping plate. Furthermore, the frictional resistance in the numerous moving contact points in this type of dual rod drive-belt assembly presents a source of wasted energy and loss of efficiency. Loss of efficiency is inherent in such a dual rod clamping apparatus due to the numerous moving parts and frictional contact surfaces required. Additionally, any slippage in the drive belt connecting the two rods will result in an asynchronous axial rotation of the two thread rods, resulting in a non-horizontal clamping plate. If the clamping plate becomes angled, or non-horizontal, the downward force of the clamping plate would concentrate on one point on the edge of the container rather than evenly over the entire surface of the container. This problem, depending on the downward force generated, could result in crushing the paint container and spillage of the paint within the paint shaker. Even if the container withstands the irregularly angled force exerted by the non-horizontal clamping plate, the container may not be properly secured and might loosen after the shaking begins, creating a dangerous condition for the operator and potential liability for the paint retailer supplying the paint mixing machine.

SUMMARY OF THE INVENTION

Accordingly, it is an object of this invention to provide an automatic clamping apparatus for paint mixers which obviates the aforementioned deficiencies of conventional automatic clamping devices.

More specifically, it is an object of this invention to provide a more direct clamping force which reduces the amount of frictional energy dissipated by screwing motions.

Another object of the invention is to provide vertical movement of the clamping plate by direct vertical piston movement to more quickly and efficiently raise and lower the clamping plate.

It is a further objection of the present invention to provide a clamping plate design which reduces the potential of the clamping plate becoming non-horizontal by applying a direct vertical force upon the center of the clamping plate which can be further guided along the edges by vertical guides.

It is yet another object of the present invention to provide a clamping apparatus which automatically and more accurately detects and controls the compressive force of the clamping plate on the paint container.

In accordance with the present invention, all of these objects, as well as others not herein specifically identified, are achieved generally by the present automatic clamping apparatus for paint mixers. More specifically, the present invention includes a clamping plate, a linear actuator with a housing and moveable piston, and a current sensor. The clamping plate is positioned within the shaking compartment of the paint mixer and oriented to be parallel with the horizontal plane. The linear actuator is vertically aligned over the center of the clamping plate which is secured to the extending end of the moveable piston protruding vertically from the housing. The housing of the linear actuator is secured to the framework of the shaking compartment so that the relative position of the piston and the clamping plate to the bottom plate of the shaking compartment will be unaffected by the shaking operation. The configuration of the present invention allows the linear actuator to maintain securing force on the paint container throughout the entire mixing process. The power for the linear actuator is fed through a current sensor which can detect when the clamping plate eventually pushes down upon the top of the paint container. At this point, the power to the linear actuator can be shut off or decreased according the specific application and physical parameters.

BRIEF DESCRIPTION OF THE DRAWINGS

Further objects of the invention, taken together with additional features contributing thereto and advantages occurring therefrom, will be apparent from the following description of the invention when read in conjunction with the accompanying drawings, wherein.

DETAILED DESCRIPTION OF THE INVENTION

Figure 1:
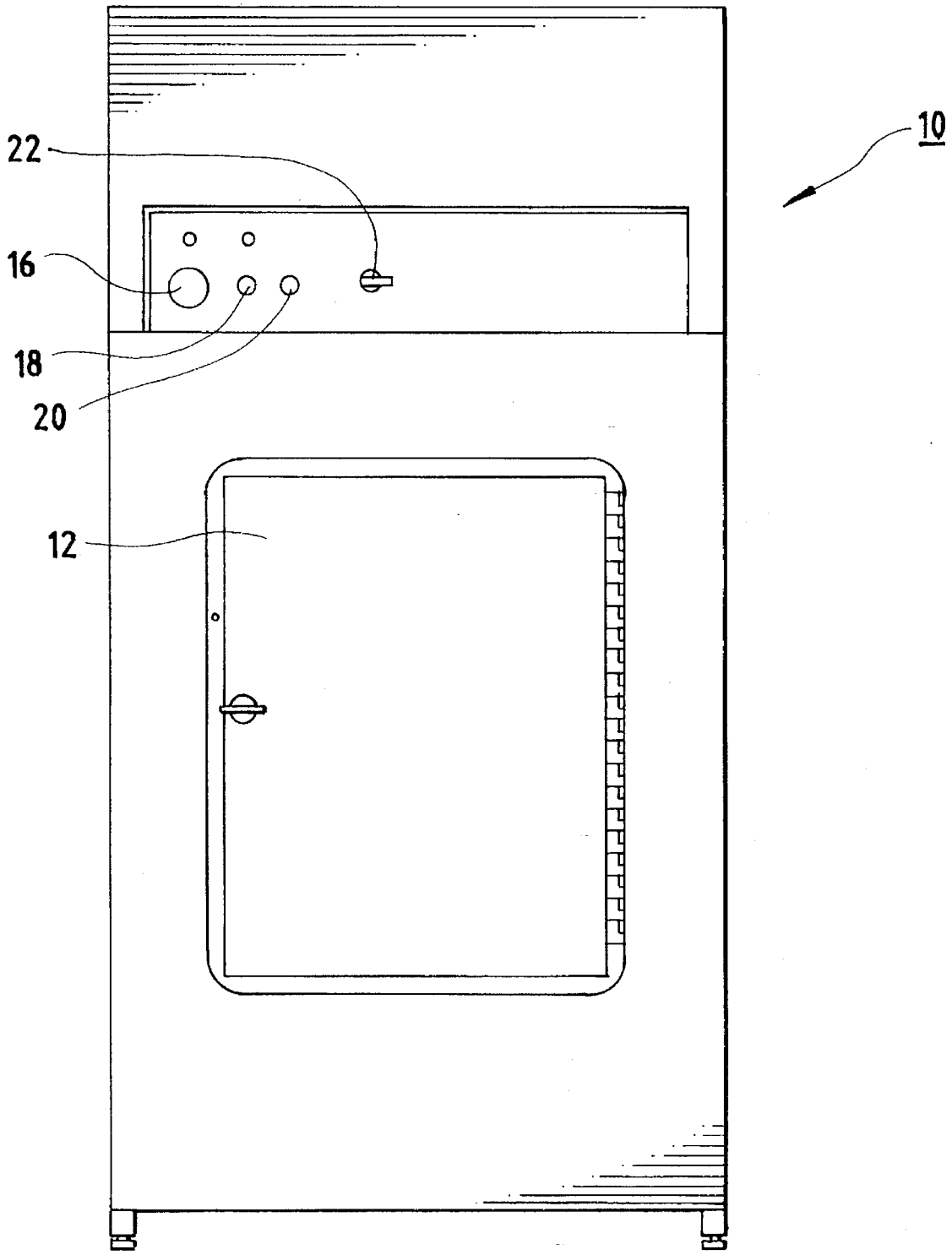
FIG. 1 is a front view of the exterior of a paint mixer of the subject invention.

FIG. 1 depicts the outer appearance of a paint mixer generally designated as 10, having a door 12 and four controls 16, 18, 20 and 22. The door 12 is opened to access the shaking compartment 38 (best seen in FIG. 2) in which the paint container 14 is placed on top of the bottom plate 42. There are four controls: an emergency stop button 16, a start button 18, a reset button 20, and the timer setting dial 22. The emergency stop button 16, when depressed, will cease mixing operation at any point during the operation of the paint mixer 10. The start switch 18 is depressed after placing the paint container 14 into the paint mixer 10 and begins the automatic mixing process in which the paint container 14 is automatically secured and then shaken. The reset switch 20 stops the operation of the paint mixer 10 and places the paint mixer 10 in the initial wait stage of operation. The timer setting dial 22 controls the duration of the mixing operation and is set by the operator before the paint mixer 10 is activated.

Figure 2:
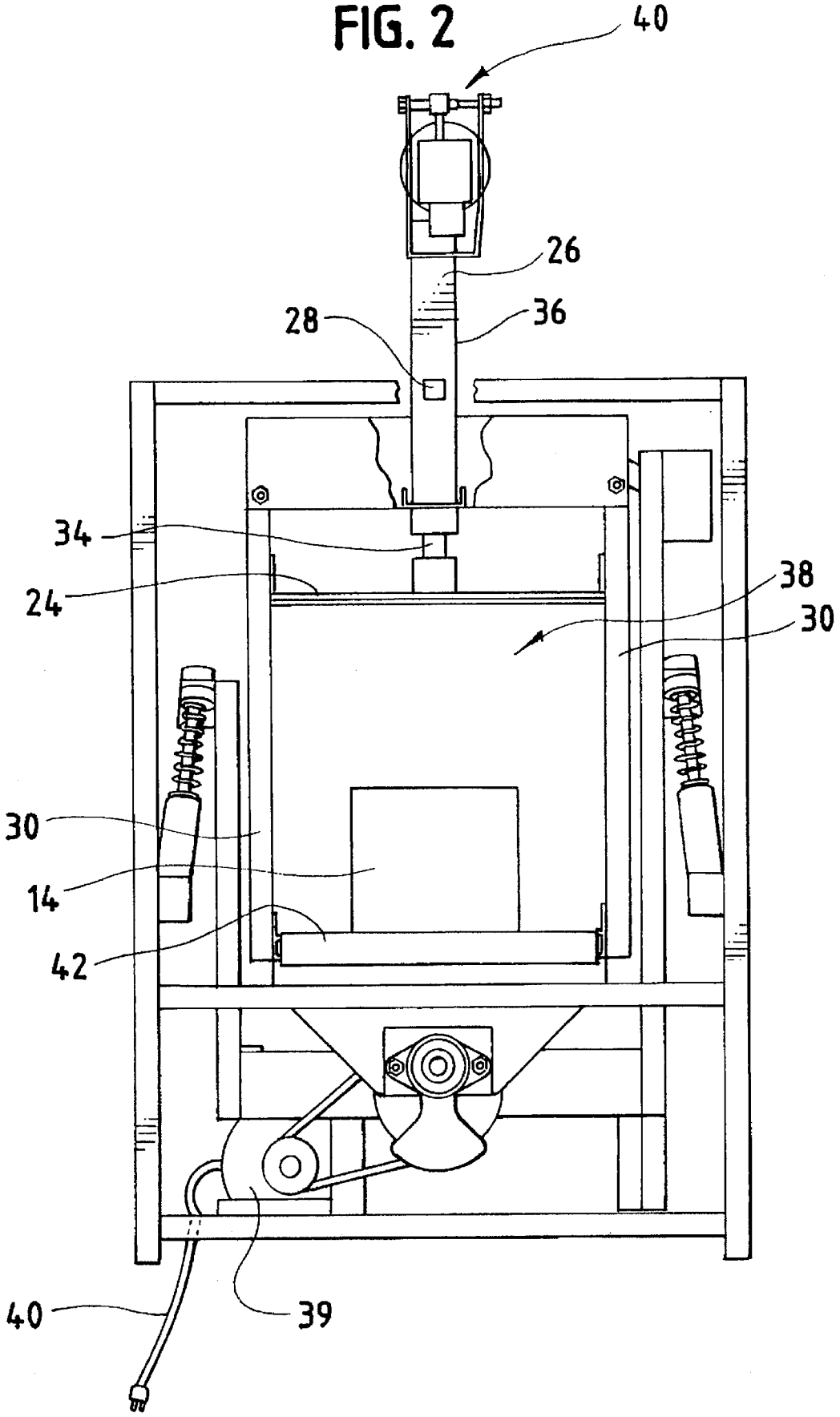
FIG. 2 is a front sectional view of the automatic clamping apparatus relative to the framework of the shaking compartment within the paint mixer of the subject invention, a paint container resting therein.
Figure 3:
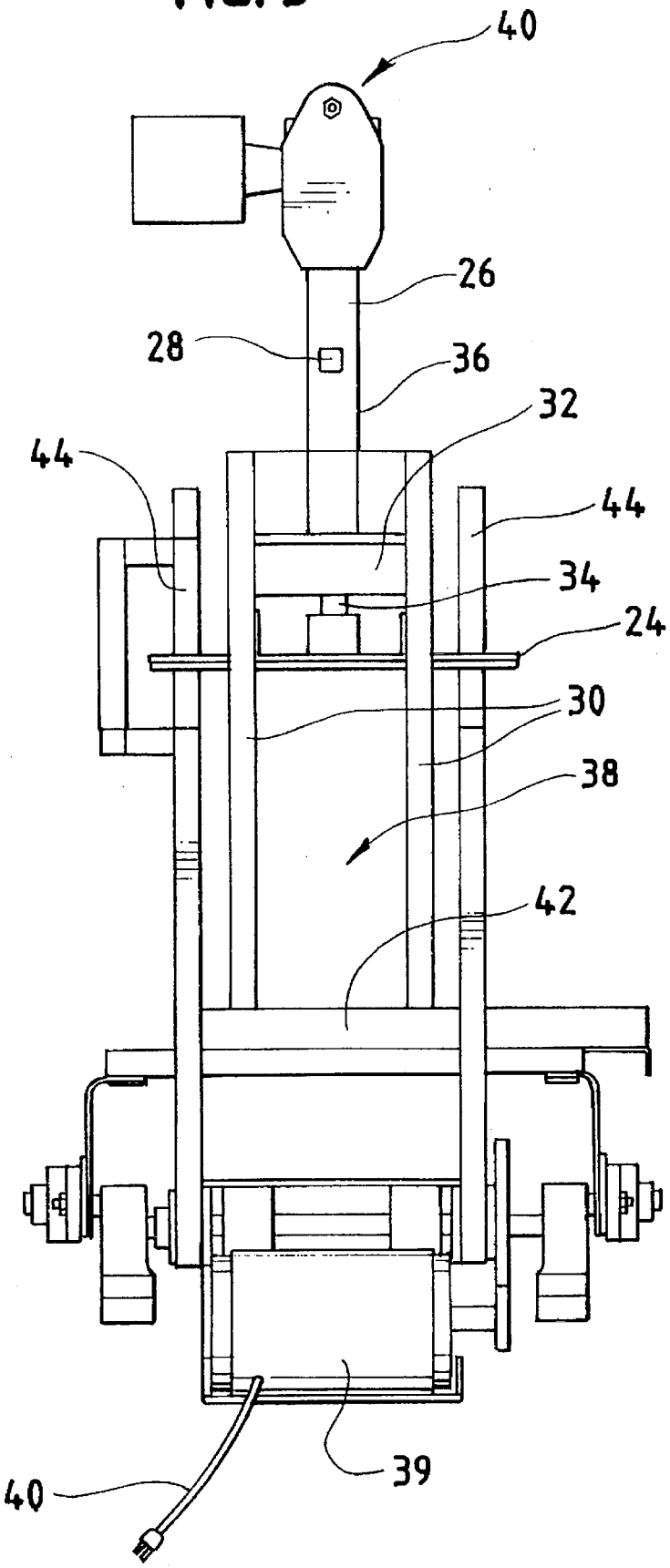
FIG. 3 is a side sectional view of FIG. 2 depicting the automatic clamping apparatus within the framework of the shaking compartment.

Referring to FIGS. 2 & 3, the automatic clamping apparatus consists of clamping plate 24, a linear actuator generally designated as 26, and a current sensor 28. The clamping plate 24 is rectangular in shape, conforming to the dimension of the shaking compartment 38 defined by the side frames 30 and top frame 32 and is enclosed within the shaking compartment 38. The shape of the clamping plate 24 could be of other planar shapes so long as the clamping plate 24 is of sufficient shape and surface area to apply an even perpendicular force onto the top of a paint container 14. The clamping plate 24 is oriented such that its planar surface is perpendicular to the vertical axis.

The linear actuator 26 consists of a moveable piston 34 enclosed within a cylindrical housing 36. The linear actuator 26 is oriented perpendicularly to the planar surface of the clamping plate 24, and its housing 36 is secured to the top frame 32 of the shaking compartment 38. The lower end of the moveable piston 34 is attached to the upper surface of the clamping plate 24 at its center, forcing the clamping plate 24 in a vertical direction when the linear actuator 26 is operated. Due to the housing 36 being secured to the frames 30 and 32 of the shaking compartment 38, the relative position of the clamping plate 24 within the shaking compartment 38 remains the same during shaking operations, hence maintaining downward force on a paint container 14. The upper end of the linear actuator 26 is connected to a swivel configuration 40 to allow the upper end to move freely with the movement of the top frame 32 to which the housing 36 is secured. The linear actuator 26 is electrically powered, and the current provided to the linear actuator 26 is monitored by a current sensor 28. It has been found that linear actuators manufactured by Dayton Electric Manufacturing Co., Models 4Z841, 4Z842, 4Z843B, 4Z844B, 5A701 and 5A702, work well for the present invention.

In the preferred embodiment of the invention, a paint container 14 is placed within the shaking compartment 38 on top of the bottom plate 42. The door 12 is shut and the mixing time selected. When the start button 18 is depressed, the linear actuator 26 is powered to apply direct downward force on the moveable piston 34 until the clamping plate 24 pushes down upon the top of the paint container 14. Due to the centering of the downward force of the moveable piston 34 on the clamping plate 24, as opposed downward force created on the two ends of the clamping plate 24 as in the threaded dual-rod configuration, the downward force will be more uniformly distributed on the top of the centered paint container 14. Likewise, the potential for the clamping plate 24 to come down and press in a non-horizontal plane is eliminated by not having two separate and opposite points at which the clamping plate 24 is forced down.

The direct application of vertical force at a single location on the center of the clamping plate 24, as opposed to two vertical forces created by axial rotation of threaded rods, reduces the time and energy required to move the clamping plate 24 in a vertical direction. At this point, the upward resistance caused by the paint container 14 causes less current to flow into the linear actuator 26. The current sensor 28 detects the decrease in current and shuts off power to the linear actuator 26, effectively locking the clamping plate 24 in position on top of the paint container 14. The current sensor 28 in the present invention is able to more accurately detect the amount of resistant force because the resistant force directly opposes the vertical movement of the moveable piston 34 rather than the indirect process of the dual threaded-rod configuration in which the vertical resistant force is converted to the rotational resistance of the threaded rods. The direct method of sensing the current flow results in a more consistent control of the clamping force and is less sensitive to the various frictional resistances inherent with the threaded dual-rod configuration, which could produce varying clamping forces with each use.

The paint mixer 10 then begins agitating the shaking compartment 38 via a notor 39 connected to a source of electrical power by a power line 40, for the predetermined time period which was selected by the operator. When the shaking is completed, reverse power to the linear actuator 26 causes the moveable piston 34 to rise, lifting the clamping plate 24 off the paint container 14, at which time the door 12 may be opened and the paint container 14 removed.

In another embodiment, as shown in FIG. 3, guides 44 could be provided along the edges of the clamping plate 24 to further assist in uniformly moving the clamping plate 24 in a vertical direction. The guides 44 could be vertical beams placed along the outer edges of the clamping plate 24 to restrict horizontal movement of the clamping plate 24. The guides 44 could also consist of rollers and tracks to direct the vertical and horizontal movement of the clamping plate Additionally, full or partial power could be provided to the linear actuator 26 during the shaking operation to provide continuous downward force during the entire mixing process. The amount of power provided could be adjusted according to the particular application based upon such factors as the tensile strength and shape of the paint container 14. The amount of power supplied to the linear actuator 26 could be easily regulated by any conventional control device 46 which is responsive to the status of the current sensor 28. A compressible layer could also be applied to the bottom surface of the clamping plate 24 to further provide a means for securing the paint container 14.

Furthermore, the linear actuator 26 need not be an electrically powered device. Rather, any suitable linear actuator 26, whether pneumatic, hydraulic or otherwise, could be used to achieve the same results. The type of sensor 28 would accordingly be of the same type as the linear actuator 26 and capable of detecting a resistant force.

The foregoing specification describes only the preferred embodiments of the invention as shown. Other embodiments besides the one herein shown and described may be articulated as well. The terms and expressions therefore serve only to describe the invention by example and are not intended to limit the invention. It is expected that others skilled in the art will perceive differences which, while differing from the foregoing, do not depart from the spirit and scope of the invention herein described and claimed.

What is claimed is:

1. An automatic clamping apparatus for paint mixers which secures a paint container to the bottom plate of a shaking compartment during a shaking process, the shaking compartment defined by side frames and a top frame, comprising, in combination:

a clamping plate having an upper and lower surface and a center, said clamping plate located within said shaking compartment, said upper and lower surfaces being parallel with a horizontal plane;

actuating means for effecting vertical movement of said clamping plate by exerting a vertical force thereon, said actuating means having a lower end and an upper end, said lower end connected to said center of said clamping plate, said actuating means fixedly secured to the shaking compartment;

sensor means for detecting a resistant force against said actuating means, said sensor means having an output corresponding to said resistant force; and control means for adjusting said vertical force exerted by said actuating means, said control means being responsive to said output from said sensor means, wherein said control means decreases said vertical force exerted by said actuating means when said sensor means detects a predetermined amount of said resistant force on said actuating means, and said control means reverses said vertical force when the shaking process is completed, thereby causing said actuating means to retract and lift said clamping plate.

2. The automatic clamping apparatus as described in claim 1 wherein said actuating means is an electrically powered linear actuator having a housing and a moveable piston protruding downward from a lower end of said housing, said linear actuator oriented vertically over said center of said clamping plate, said moveable piston attached to said center, and said housing fixedly secured to the top frame of the shaking compartment.

3. The automatic clamping apparatus as described in claim 2 wherein said control means is a switch having an on and off state dependent upon said output of said sensor, wherein power is supplied to said linear actuator in said on state and no power is supplied to said linear actuator in said off state.

4. The automatic clamping apparatus as described in claim 3 further comprising a swivel configuration attached to said upper end of said linear actuator to secure said linear actuator to the paint mixer without restricting the movement of said linear actuator during the shaking process.

5. The automatic clamping apparatus as described in claim 3 further comprising means for guiding said vertical movement of said clamping plate when said linear actuator exerts said vertical force.

6. The automatic clamping apparatus as described in claim 3 further comprising a compressible layer secured to said lower surface of said clamping plate.

7. The automatic clamping apparatus as described in claim 1 further comprising means for centering the paint container on the bottom plate.

8. An automatic clamping apparatus for paint mixers which secures a paint container to the bottom plate of the shaking compartment during a shaking process, the shaking compartment defined by side frames and a top frame, comprising, in combination:

a clamping plate having an upper and lower surface and a center, said clamping plate located within said shaking compartment, said upper and lower surfaces being parallel with a horizontal plane;

a linear actuator having a moveable piston, a housing, a motor and a power line, said linear actuator oriented perpendicularly to said upper and lower surfaces of said clamping plate, said moveable piston enclosed within said housing and protruding downward from a lower end of said linear actuator, said moveable piston attached to said center of said clamping plate at said upper surface, said moveable piston driven vertically by said motor to provide a vertical force on said clamping plate, said motor receiving power through said power line, said housing fixedly secured to the top frame of the shaking compartment, wherein said linear actuator moves in unison with the shaking compartment during the shaking process;

a current sensor having an output, said status output corresponding to a rate of current flow to said linear actuator through said power line; and a power control connected and responsive to said output of said current sensor, wherein said power control decreases the power to said linear actuator when said current sensor detects that said clamping plate is pushing against said paint container, and said power control reverses power to said linear actuator to raise said clamping plate when the shaking process is completed.

9. The automatic clamping apparatus as described in claim 8 further comprising a swivel configuration attached to an upper end of said linear actuator to secure said linear actuator to the paint mixer without restricting the movement of said linear actuator during the shaking operation.

10. The automatic clamping apparatus as described in claim 8 further comprising means for guiding a vertical movement of said clamping plate when said linear actuator exerts said vertical force.

11. The automatic clamping apparatus as described in claim 8 further comprising a compressible layer secured to said lower surface of said clamping plate.

* * * * *